US006201483B1

(12) United States Patent
Ziehm

(10) Patent No.: US 6,201,483 B1
(45) Date of Patent: Mar. 13, 2001

(54) BOAT STEERING CENTERED INDICATOR

(76) Inventor: Fritz Ziehm, 47026 Jefferson, Chesterfield, MI (US) 48047

( * ) Notice: Subject to any disclaimer, the term of this patent is extended or adjusted under 35 U.S.C. 154(b) by 0 days.

(21) Appl. No.: 09/479,583

(22) Filed: Jan. 7, 2000

(51) Int. Cl.[7] ..... B63H 25/36
(52) U.S. Cl. ..... 340/987; 114/144 R; 114/162
(58) Field of Search ..... 340/987; 114/162, 114/144 A, 144 R, 26, 343; 701/21

(56) References Cited

U.S. PATENT DOCUMENTS

| | | | | |
|---|---|---|---|---|
| 3,181,491 | | 5/1965 | Dunning | 114/150 |
| 3,331,350 | | 7/1967 | Norton | 116/31 |
| 3,636,910 | * | 1/1972 | Tsuchiya | 440/59 |
| 4,334,491 | | 6/1982 | Kulischenko | 116/31 |
| 4,912,465 | | 3/1990 | Greer | 340/987 |
| 5,031,561 | * | 7/1991 | Nilsson | 114/144 R |
| 5,052,327 | | 10/1991 | Comfort | 116/26 |
| 5,107,424 | * | 4/1992 | Bird et al. | 364/424.01 |
| 5,207,604 | * | 5/1993 | McMillin | 440/62 |
| 5,214,363 | * | 5/1993 | Wisner et al. | 318/588 |
| 5,361,024 | * | 11/1994 | Wisner et al. | 318/588 |

* cited by examiner

*Primary Examiner*—Jeffery A. Hofsass
*Assistant Examiner*—Toan Pham
(74) *Attorney, Agent, or Firm*—Young & Basile, PC

(57) ABSTRACT

A steering position indicator system for a boat provides the boat operator with a signal to indicate when the boat's steering control means is centered with respect to the boat's centerline. The system employs a proximity sensor mounted on the hull or transom of the boat and a sensor actuator mounted to a steering linkage bar extending between left and right steerable outdrive units or rudders. The proximity sensor and sensor actuator are positioned relative to one another such that the sensor detects the actuator and closes a circuit only when the outdrive units are centered with respect to the boat's centerline. The indicator includes a light or buzzer and is mounted adjacent a helm position of the boat and alerts the boat operator when the sensor detects the sensor actuator. The proximity sensor may be optical, magnetic, or inductance. A switch allows the boat operator to select either an audible or a visible signal.

8 Claims, 2 Drawing Sheets

BOAT STEERING CENTERED INDICATOR

FIELD OF THE INVENTION

This invention relates to boats which are steered by turning stern-mounted engines or rudders, and more specifically to a system for providing an operator of such a boat an indication of when the boat's steering control means is centered with respect to the boat.

BACKGROUND OF THE INVENTION

When operating a twin-engine boat at slow speed and in tight quarters, the greatest maneuverability is achieved by operating the engines separately, placing one screw in reverse and the other in forward depending on which direction the boat is to be turned. It is difficult to maneuver a boat effectively and predictably in this manner, however, unless the boat's rudders, steerable outdrives, or outboard motors are centered with respect to the boat. At slow speed, it is often difficult for the operator to tell the left/right position of the boat's steering means.

It is known to provide a steering position indicator for giving a visual indication to a boat operator of the orientation of the boat's steering control means. Existing steering position indicator devices have generally employed relatively complicated mechanical linkages or electrical circuits to drive a gauge-type indicator located near the steering wheel or helm.

SUMMARY OF THE INVENTION

The present invention provides a steering position indicator which is inexpensive and simple to install on a boat and provides the operator with an accurate, reliable indication of when the steering control means is centered.

The inventive system employs a proximity sensor connected in an electric circuit including an indicator device such as a light or buzzer, and a sensor actuator for triggering the sensor to alternatively open and close the circuit. Either the sensor or the actuator is mounted on a portion of the steering control means which moves when the boat is steered, and the other is mounted to a fixed portion of a boat adjacent the steering control means. The sensor and actuator are positioned relative to one another such that the proximity sensor detects the sensor actuator and closes the circuit only when the steering control means is in a centered position. The indicator is mounted adjacent a helm position of the boat and alerts the boat operator when the sensor detects the sensor actuator.

In a preferred embodiment of the invention disclosed herein, the sensor actuator is mounted to a steering linkage bar extending between a left and right steerable outdrive units at the stern of the boat. The proximity sensor is mounted between the left and right outdrive units on the hull or transom of the boat and is positioned so that the sensor actuator is aligned with the sensor only when the outdrive units are centered with respect to the boat's centerline.

In the preferred embodiment of the invention, the proximity sensor is an optical sensor having a transmitter which generates an infrared beam and a receiver immediately adjacent the transmitter which detects infrared energy reflected back toward the proximity sensor when an object is aligned with and sufficiently close to the transmitter.

Also in the preferred embodiment of the invention, the indicator includes a light to provide a visible signal and a buzzer or chime to produce an audible signal. A switch allows the boat operator to select either the audible or the visible signal. The audible signal is valuable for occasions when bright sunlight makes the light difficult to see, or when it is not convenient for the operator to be looking toward the indicator.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
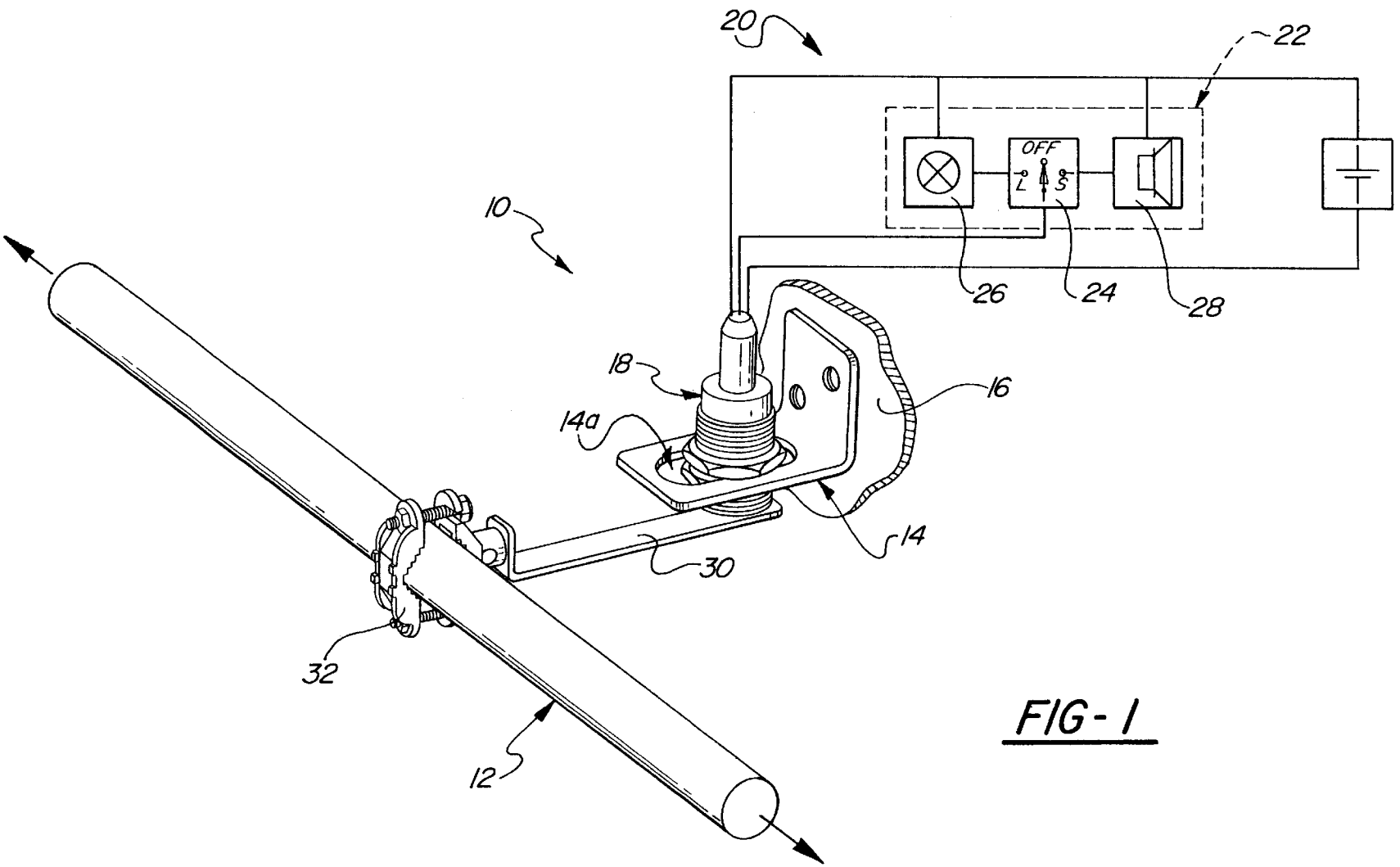
FIG. 1 is a partial perspective view of a steering centered indicator according to the present invention with the electrical circuit depicted schematically.
Figure 3:
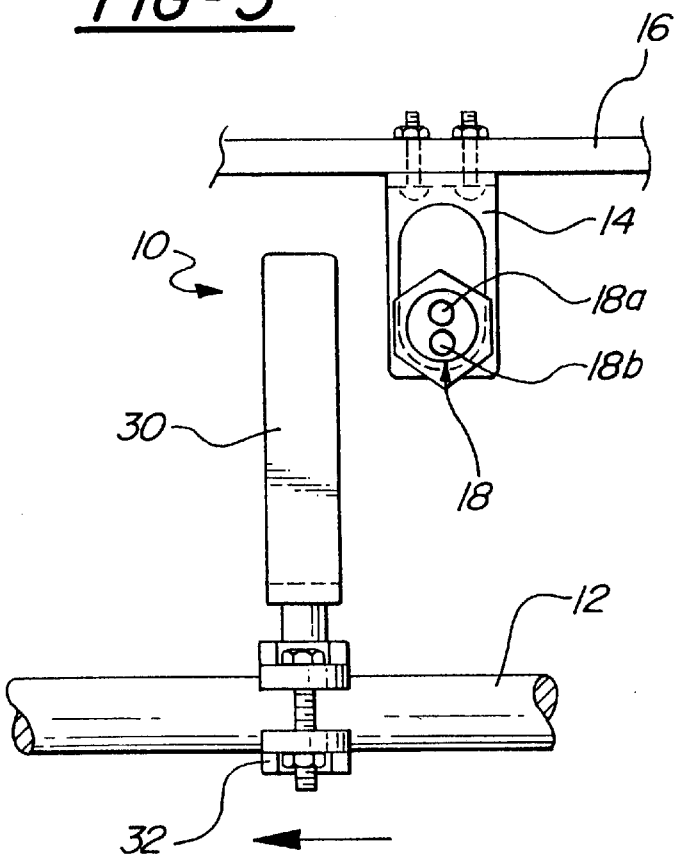
FIG. 3 is a view similar to FIG. 2 when the steering control means is not centered.
Figure 2:
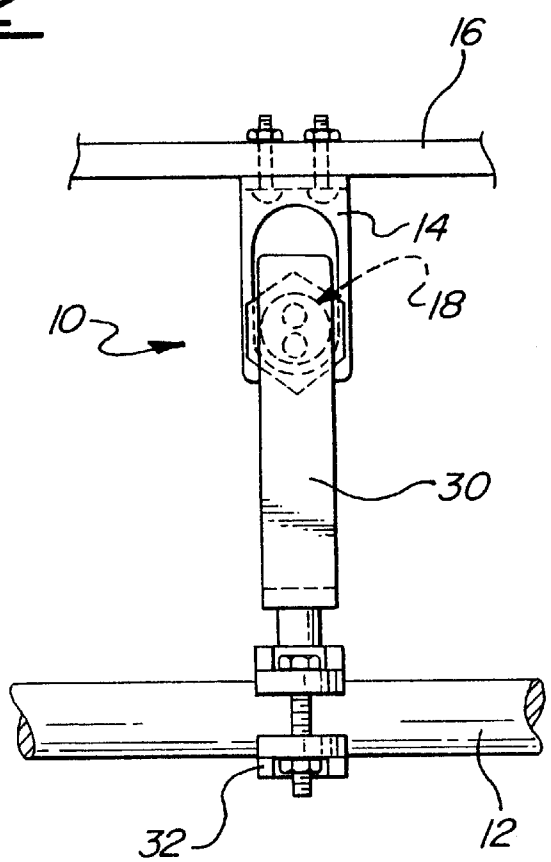
FIG. 2 is a partial bottom view showing the invention indicator system with the steering control means centered.

FIGS. 1–3 show a steering centered indicator system according to the present invention, indicated generally as 10, installed on a boat having a steering control means comprising a steering linkage bar 12 which connects twin movable rudders or outdrive units (not shown). The steering control means further comprises mechanical components such as cables and/or hydraulic actuators (not shown) which, in a manner well known in the art, transmit steering commands from a steering wheel or helm (not shown) to steering linkage bar 12, moving it left and right along its longitudinal axis to thereby move the outdrives or rudders in unison.

An L-shaped bracket 14 is bolted or otherwise secured to a fixed portion of the boat, such as the inner surface of the hull or transom 16, and an electrically powered proximity sensor 18 is mounted to the bracket. In the preferred embodiment, proximity sensor 18 is of the type comprising a small transmitter 18*a* (see FIG. 3) which generates an infrared (IR) beam and a receiver 18*b* which detects infrared radiation reflected back toward sensor 18 when the IR beam is blocked by a solid object sufficiently close to the sensor. Bracket 14 preferably has a slot 14*a* or some other means to allow the position of proximity sensor 18 to be adjusted relative to the bracket.

Alternatively, other well known and commercially available types of proximity sensors may also be used, such as magnetic or inductance sensors.

Proximity sensor 18 is connected to a circuit 20 which is preferably connected to the boat's electrical system. Circuit 20 is connected to an indicator 22 comprising a manually operated switch 24, a visible indicator 26 such as a light bulb or light emitting diode, and an audible indicator 28 such as a buzzer, horn or chime. Switch 24 has three positions: OFF, in which circuit 20 is open so that neither of the indicators 26,28 can be energized; LIGHT (L), in which visible indicator 26 is energized when proximity sensor 18 is activated; and SOUND (S), in which audible indicator 28 is energized when proximity sensor 18 is activated. Indicator 22 is preferably mounted on a panel adjacent the boat's steering wheel or helm station so that switch 24 can be conveniently reached and actuated by the boat operator.

A sensor actuator 30 is mounted to steering linkage bar 12 by a clamp 32 or other appropriate fastening means and extends beneath proximity sensor 18. Sensor actuator 30 is preferably a bar of metal or plastic material and is located on steering linkage bar 12 so that the actuator is in close proximity to and directly aligned with infrared transmitter 18*a* and receiver 18*b* when steering linkage bar 12 is in a position corresponding to the boat's steering control means being centered with respect to the boat's centerline. (See FIG. 2). In this position, actuator 30 reflects a sufficient amount of IR energy from transmitter 18*a* back to receiver 18*b* and thereby triggers proximity sensor 18. Triggering of proximity sensor 18 causes it to close circuit 20 if switch 24 is in either the LIGHT or SOUND position.

When the steering wheel is turned to move the outdrive units away from the centered position to either the left or right, steering linkage bar 12 moves so that sensor actuator 30 is shifted out of alignment with sensor 18. (See FIG. 3). In this position, sensor actuator 30 does not reflect the IR beam from transmitter 18*a* back to receiver 18*b*. In the absence of the reflected IR energy, sensor 18 produces an open-circuit condition so that indicator 22 is not energized even if switch 24 is closed.

The invention steering centered indicator system 10 will typically remain switched off when the boat is being steered in the normal fashion using the steering wheel and both engines running forward. When it is desired to steer the boat by placing one engine in reverse and the other in forward, the boat operator activates the system by turning switch 24 to either LIGHT or SOUND. This will normally be done when both engines are in neutral. The steering wheel is then turned until the steering control means is in the centered position, resulting in the invention system 10 producing the selected visible or audible signal. The operator then turns switch 24 to OFF, holds or locks the steering wheel so that it remains centered, and operates the throttles and gear selectors of the engines as desired to maneuver the boat.

While the preferred embodiment of the invention disclosed herein is shown used on a boat having twin inboard/outdrive propulsion with the outdrives connected by a steering linkage bar, the invention system is also useable with boats having any number of outdrive motors, outboard motors, or inboard motors with separate rudders for steering. In all of these cases, proximity sensor 18 is preferably mounted on a fixed portion of the boat and sensor actuator 30 is preferably mounted on some appropriate, moveable portion of the steering control means.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A system for indicating to an operator of a boat when a steering control means of the boat is in a centered position with respect to the boat's centerline, the system comprising:

a proximity sensor;

a sensor actuator, a first of the proximity sensor and the sensor actuator mountable on a portion of the steering control means for movement along with the steering control means when the steering control means is actuated to steer the boat, and a second of the proximity sensor and the sensor actuator mountable on a fixed portion of the boat adjacent the portion of the steering control means such that the proximity sensor is able to detect the sensor actuator only when the sensor actuator is in a position corresponding to the centered position of the steering control means; and an indicator mountable on the boat and electrically connected with the proximity sensor, the indicator producing a signal to alert the operator when the sensor actuator is in the position corresponding to the centered position of the steering control means.

2. The system according to claim 1 wherein the sensor actuator is mountable to a steering linkage bar connecting first and second steerable propulsion units of the boat and the proximity sensor is mounted to the fixed portion of the boat.

3. The system according to claim 1 wherein the proximity sensor is an optical sensor.

4. The system according to claim 1 wherein the proximity sensor is a magnetic sensor.

5. The system according to claim 1 wherein the signal is a visible signal.

6. The system according to claim 1 wherein the signal is an audible signal.

7. The system according to claim 1 further comprising a switch mountable adjacent the indicator for controlling the supply of electrical power to the proximity sensor.

8. The system according to claim 1 wherein the indicator is mountable adjacent a steering wheel of the boat.

* * * * *